US005746183A

United States Patent [19]

Parke et al.

[11] Patent Number: 5,746,183

[45] Date of Patent: May 5, 1998

[54] METHOD AND SYSTEM FOR CONTROLLING FUEL DELIVERY DURING TRANSIENT ENGINE CONDITIONS

[75] Inventors: Alastair William Parke, Ann Arbor; Jeffrey Allen Doering, Canton; Paul Charles Mingo, Farmington Hills; Xiaoying Zhang, Dearborn Heights; Robert Matthew Marzonie, Northville, all of Mich.

[73] Assignee: Ford Global Technologies, Inc., Dearborn, Mich.

[21] Appl. No.: 887,286

[22] Filed: Jul. 2, 1997

[51] Int. Cl.[6] ..... F02M 51/00

[52] U.S. Cl. ..... 123/492

[58] Field of Search ..... 123/492, 493, 123/480

[56] References Cited

U.S. PATENT DOCUMENTS

| | | | |
|---|---|---|---|
| 5,546,910 | 8/1996 | Messih et al. | 123/492 |
| 5,564,393 | 10/1996 | Asano et al. | 123/492 |
| 5,584,277 | 12/1996 | Chen et al. | 123/480 |
| 5,609,139 | 3/1997 | Ueda et al. | 123/492 |

OTHER PUBLICATIONS

SAE Technical Paper No. 961188, "Model-Based Fuel Injection Control System For SI Engines", by Masahiro Nasu et al, May 6–8, 1996, pp. 85–95.

*Primary Examiner*—Raymond A. Nelli

*Attorney, Agent, or Firm*—Allan J. Lippa; Roger L. May

[57] ABSTRACT

A method and system for determining and controlling the fuel mass to be delivered to an individual cylinder of an internal combustion engine during engine transients compensates for fuel transport dynamics and the actual fuel injected into the cylinder. A plurality of engine parameters are sensed, including cylinder air charge. An initial base desired fuel mass is determined based on the plurality of engine parameters. An initial transient fuel mass is also determined based on prior injection history for that cylinder. A desired injected fuel mass to be delivered to the cylinder is determined based on the initial base desired fuel mass and the initial transient fuel mass. These same calculations are then used to compensate for changes to the base desired fuel mass while the fuel injection is in progress, resulting in an updated desired injected fuel mass. Finally, the injection history for that cylinder is updated to account for the actual desired fuel mass delivered to the cylinder.

18 Claims, 2 Drawing Sheets

METHOD AND SYSTEM FOR CONTROLLING FUEL DELIVERY DURING TRANSIENT ENGINE CONDITIONS

CROSS-REFERENCE TO RELATED APPLICATIONS

This application is related to U.S. patent application entitled "Method and System for Controlling Fuel Delivery During Engine Cranking", which is assigned to the assignee and has the same filing date as the present application.

TECHNICAL FIELD

This invention relates to methods and systems for controlling mass of fuel delivered to an individual cylinder during transient engine conditions.

BACKGROUND ART

Under steady-state engine operating conditions, the mass of air charge for each cylinder event is constant and the fuel transport mechanisms in the fuel intake have reached equilibrium, thus, allowing a constant mass of injected fuel for each event in each cylinder. When the operating condition is not steady-state, due to transients in the mass of air charge or to all the cylinders not being fueled for each event, the mass of injected fuel required to achieve the desired air/fuel ratio in the cylinder is not constant.

Prior art transient fuel compensation methods have added a transient fuel pulsewidth to the closed-valve injection pulsewidth, or delivered an additional asynchronous or synchronous open-valve injection pulsewidth. These methods calculated the transient fuel portion of the pulsewidth based on an estimate of the fuel stored in the engine intake system, modeled as one large fuel "puddle". This puddle was estimated based on the initially intended fuel pulsewidths of all the cylinders taken as a whole. In this case, the actual delivered pulsewidths could be significantly different than the initially intended pulsewidths due to pulsewidth delivery limitations, changes in estimated engine air charge after initial fuel scheduling, or disabling of the fueling to a cylinder for torque control or other reasons. Since all the cylinders are treated as one cylinder, the puddle estimate does not represent the fueling history of the individual cylinders, leading to gross errors in the fuel mass inducted by specific cylinders during transient engine conditions. Furthermore, if the transient fuel calculations resulted in requesting injection pulsewidths that were not achievable by the fuel injector (i.e., too large or negative), the puddle estimates are calculated assuming the requested fueling was achieved.

These prior methods assumed that the requested compensation during transient engine conditions was achievable and based future fuel calculations on that premise, but under many conditions that premise is incorrect. Because the fuel injection histories for different cylinders in an engine can vary significantly and the initially scheduled fuel injection pulsewidths can differ significantly from the actual delivered injection pulsewidths, these methods produce intake fuel puddle mass estimates that are inaccurate. An inaccurate puddle estimate affects fuel calculations for cylinder cut-out resulting in disabling of fuel to specific cylinders, updates to injector pulsewidths in progress, dynamic (or open-valve) fuel pulses and decel fuel shutoff. The resulting error in subsequent fueling calculations is most evident under conditions where the cylinders are not being fueled similarly, such as when certain cylinders are not being fueled for a period of time to reduce engine torque (e.g., traction control, torque reduction for transmission shifting, etc.).

Thus, there exists a need to improve transient air/fuel control during transient engine conditions by compensating for fuel transport dynamics and the actual fuel injected into each cylinder. There is also a need to deliver the best estimate of desired injected fuel mass when that estimate improves after the injector on and off edges have initially been scheduled.

DISCLOSURE OF THE INVENTION

It is thus a general object of the present invention to provide a method and system for determining the fuel mass to be delivered to an individual cylinder of an internal combustion engine during transient engine conditions.

In carrying out the above object and other objects, features, and advantages of the present invention, a method is provided for determining the fuel mass to be delivered to a cylinder during transient engine conditions. The method includes the step of sensing a plurality of engine parameters. The method also includes the step of determining an initial base desired fuel mass based on the plurality of engine parameters. The method further includes the step of determining an initial transient fuel mass based on the prior injection history. Still further, the method includes the step of determining a desired injected fuel mass to be delivered to the individual cylinder based on the initial base desired fuel mass and the initial transient fuel mass. Finally, the method includes the step of sensing delivery of the desired injected fuel mass and determining an updated prior injection history based on the desired injected fuel mass and the prior injection history.

In further carrying out the above object and other objects, features, and advantages of the present invention, a system is also provided for carrying out the steps of the above described method. The system includes a plurality of sensors for sensing a plurality of engine parameters. The system also includes control logic operative to determine an initial base desired fuel mass based on the plurality of engine parameters, determine an initial transient fuel mass based on the prior injection history, determine a desired injected fuel mass to be delivered to the individual cylinder based on the initial base desired fuel mass and the initial transient fuel mass, and sense delivery of the desired injected fuel mass to the individual cylinder and determine an updated prior injection history based on the desired injected fuel mass and the prior injection history.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
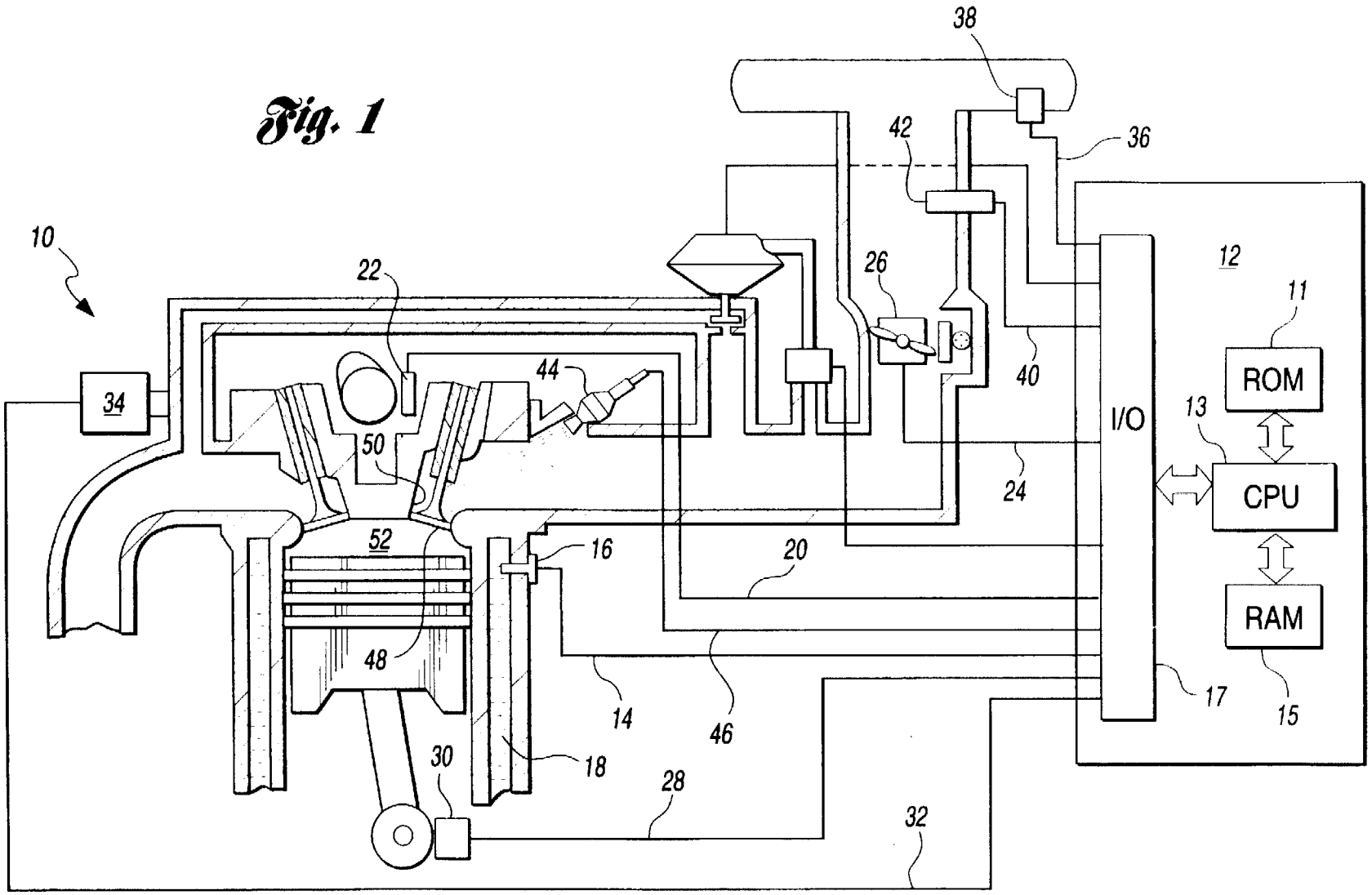
FIG. 1 is a schematic diagram of an internal combustion engine and an electronic engine controller which embody the principles of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1. The engine 10 is controlled by an Electronic Control Unit (ECU) 12 having a Read Only Memory (ROM) 11, a Central Processing Unit (CPU) 13, and a Random Access Memory (RAM) 15. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, and an air flow signal 40 from an air flow sensor 42. The ECU 12 processes these signals received from the engine and generates a fuel injector pulse waveform transmitted to the fuel injector 44 on signal line 46 to control the amount of fuel delivered by the fuel injector 44. Intake valve 48 operates to open and close intake port 50 to control the entry of an air/fuel mixture into combustion chamber 52.

The air flow signal 40 (or air charge estimate) from air flow sensor 42 is updated every Profile Ignition Pickup (PIP) event, which is used to trigger all fuel calculations. The current air charge estimate is used to calculate the desired in-cylinder fuel mass for all cylinders on each bank of the engine, wherein a bank corresponds to a group of cylinders with one head. This desired fuel mass is then used as the basis for all fuel calculations for the relevant cylinders on that bank, including initial main pulse scheduling, injector updates and dynamic fuel pulse scheduling. Since the initial main pulse for each cylinder must be scheduled in advance of delivery, the air charge estimate can change radically during transient engine conditions. In order to achieve the desired in-cylinder air/fuel ratio, the initial pulse must be modified (injector updates) and possibly augmented with an open-valve injection (dynamic fuel pulse). The change in the bank-specific desired fuel mass, calculated from the latest estimate of cylinder air charge, is used to trigger all the calculations.

A discrete first-order X and τ model is used to design a fuel compensator for a multipoint injection system, where X represents the fraction of fuel injected into the cylinder which will form a puddle in the intake port and τ represents a time constant describing the rate of decay of the puddle into the cylinder at each intake event. The discrete nature of the compensator reflects the event-based dynamics that occur in the engine cycle. Fuel transport dynamics in the intake systems of port-injected engines are clearly not linear nor first-order, but algorithm and calibration complexity lead to an optimized first-order compensation structure as follows:

$$m_p^k = \frac{m_p^{k-1} \cdot \tau}{1+\tau} + X \cdot m_{f_{inj}}^k \qquad (1)$$

$$m_{f_{cyl}}^k = m_{f_{inj}}^k (1-X) + m_p^{k-1}\left(\frac{1}{1+\tau}\right)$$

The model structure in Equation (1) leads directly to a compensator design, in which the transient fuel dynamics are cancelled, as shown below:

$$m_{f_{inj}}^k = \frac{m_{f_{des}}^k - m_p^{k-1}\left(\frac{1}{1+\tau}\right)}{1-X} \qquad (2)$$

where $m_{f_{des}}{}^k$ is the desired mass of fuel in the cylinder for event k, $m_p{}^k$ is the mass of the individual cylinder's fuel puddle after event k, $m_p{}^{k-1}$ is the mass of the individual cylinder's fuel puddle before event k, $m_{f_{inj}}{}^k$ is the mass of fuel injected before this intake event, and $m_{f_{cyl}}{}^k$ is the actual mass of fuel that enters the cylinder on this intake event. The most logical input parameters to determine X and τ are:

$$X = f_1 \text{ (manifold pressure, engine speed)} + f_2 \text{ (engine temperature, time since start)} \qquad (3)$$

$$\tau = f_s \text{ (engine temperature, time since start)},$$

where "engine temperature" and "time since start" are existing inputs in the control system to describe the effective temperature governing the transient fuel dynamics, especially the temperature of the intake valve 48 and port walls of intake port 50. This temperature may be the output of a coolant or engine head temperature sensor. Regardless of what temperature is sensed, the dynamics are related to that temperature. While explicitly estimating a relevant temperature is possible, the time and temperature dependencies allow development flexibility that is useful for describing the differences in volatility between summer and winter blend fuels.

Figure 2:
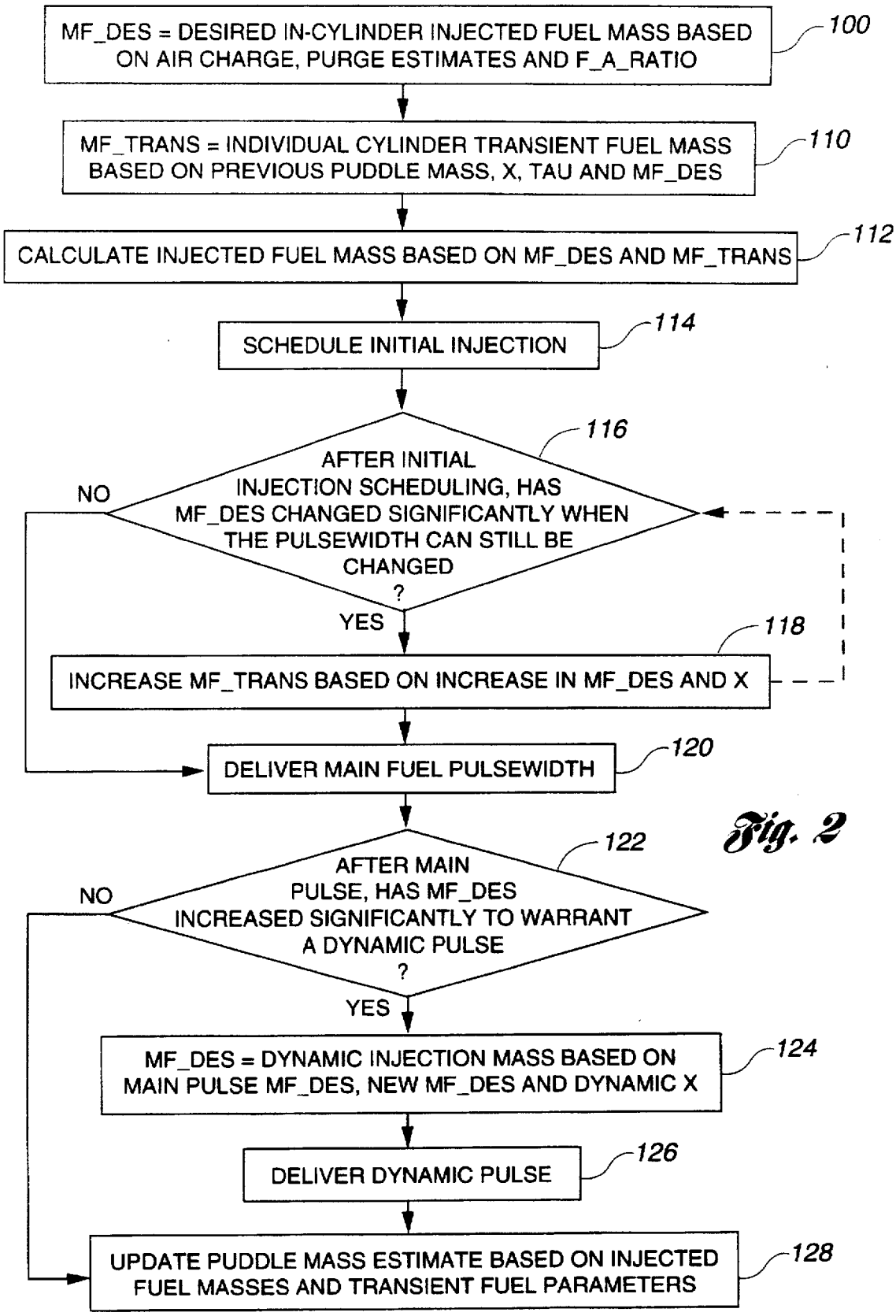
FIG. 2 is a flow diagram illustrating the general sequence of steps associated with the operation of the present invention.

Turning now to FIG. 2, there is shown a flow diagram illustrating a routine performed by a control logic, or the ECU 12. Although the steps shown in FIG. 2 are depicted sequentially, they can be implemented utilizing interrupt-driven programming strategies, object-oriented programming, or the like. In a preferred embodiment, the steps shown in FIG. 2 comprise a portion of a larger routine which performs other engine control functions.

The method begins with the step of calculating an initial estimate of desired fuel mass to be delivered to cylinder i on bank n for event k, as shown at block 100, according to the following:

$$m_{f_{base}}{}^k[i] = m_{f_{des}}{}^k[n] = cyl_air_chg \cdot f_a_ratio\,[n] - pcomp_lbm, \qquad (4)$$

where cyl_air_chg is the current estimate of inducted air mass per cylinder according to air flow signal 40, f_a_ratio [n] is the desired in-cylinder fuel-air ratio for that cylinder's bank and pcomp_lbm is the estimate of fuel mass entering the cylinder from a conventional canister purge system (not shown).

X and τ are calculated from engine speed, engine coolant temperature, manifold pressure and time since start, as mentioned above. It is possible to calibrate combinations of X and τ that produce an unstable compensator. To keep the compensator's pole inside the unit circle in the z-plane, the stability criteria for X is:

$$X < \frac{2\tau+1}{2\tau+2} \qquad (5)$$

For robustness, X is clipped to this threshold minus a safety factor before any fuel calculations are performed:

$$X_{final} = \min\left(X, \frac{2\tau+1}{2\tau+2} - \Delta X_{safety}\right) \qquad (5)$$

X and τ and a previous puddle mass estimate (described below) for cylinder i are used to calculate an initial transient fuel mass at block 110 as follows:

$$m_{f_{trans}}^{k}[i] = \left[ \frac{X \cdot m_{f_{des}}^{k}[n] - m_p^{k-1}[i]\left(\frac{1}{\tau+1}\right)}{1-X} \right] \quad (7)$$

The injected fuel mass is then calculated at block 112 as:

$$m_{f_{inj}}^{k}[i] = m_{f_{des}}^{k}[n] + m_{f_{trans}}^{k}[i] \quad (8)$$

with $m_{f_{inj}}^{k}[i]$ still being subject to the constraints on injection pulsewidths, such as, minimum injector pulsewidths, interrupt scheduling limitations, closed-valve injection timing, etc.

After the injector pulsewidth for cylinder i has been scheduled, block 114, its pulsewidth will be updated as necessary/possible based on changes in $m_{f_{des}}^{k}[n]$. If cylinder i's injection off-edge has not been delivered after a new $m_{f_{des}}^{k}[n]$ is calculated, a determination is made to see if the desired in-cylinder fuel mass has changed significantly, as shown at conditional block 116.

$$\text{If } |m_{f_{des}}^{k}[n] - m_{f_{base}}^{k}[i]| > \text{some threshold} \rightarrow \text{update injector pulsewidth} \quad (9)$$

If the injector pulsewidth for cylinder i should be updated, the base fuel required is updated, as shown at block 118, including the same transient fuel compensation equations described above, to calculate a delta change in the injected fuel mass for cylinder i:

$$\Delta m_{f_{trans}}^{k}[i] = \frac{x \cdot (m_{f_{des}}^{k}[n] - m_{f_{base}}^{k}[i])}{1-X} \quad (10)$$

$$m_{f_{base}}^{k}[i] = m_{f_{des}}^{k}[n].$$

The updated fuel mass is then delivered to the fuel injector 44, as shown at block 120.

Any lean error in what has been delivered can still be corrected with a dynamic fuel pulse during the open-valve intake event. Under some circumstances, the injector pulsewidth can be updated more than once, and the above procedure is repeated.

If cylinder i is on its intake stroke, there is one last chance to fuel additionally if $m_{f_{des}}^{k}[n]$ is larger than the desired in-cylinder fuel that has been accounted for to this point, $m_{f_{base}}^{k}[i]$. The additional fuel required is compared with the minimum amount of in-cylinder fuel the dynamic pulse can account for (including transient fuel dynamics), as shown at conditional block 122:

$$\text{If } (m_{f_{des}}^{k}[n] - m_{f_{base}}^{k}[i]) > \text{min injection mass} \cdot (1 - X_d) \rightarrow \text{perform dynamic pulse} \quad (11)$$

If a dynamic pulse can be issued for cylinder i, transient fuel compensation is included at block 124 to calculate an injected dynamic fuel mass for cylinder i, using an open-valve dynamic value, $X_d$, as follows:

$$m_{f_{dyn}}^{k}[i] = \frac{(m_{f_{des}}^{k}[n] - m_{f_{base}}^{k}[i])}{1-X_d} \quad (12)$$

After the injector's main pulse, and any dynamic pulse have been delivered, block 126, the puddle mass estimate is updated to reflect the desired system behavior and any system constraints, as shown at block 128. The puddle mass estimates must be stored in a Keep-Alive Memory (KAM) for retrieval and use on engine start-up.

$$m_p^{k}[i] = \frac{m_p^{k-1}[i] \cdot \tau}{1+\tau} + X \cdot m_{f_{inj}}^{k}[i] + X_d \cdot m_{f_{dyn}}^{k}[i] \quad (13)$$

The method and system of the present invention provide improved accuracy of fuel delivery to match air charge in the cylinder during transient events, individual cylinder compensation using individual cylinder puddle estimates that account for all fuel injected into each cylinder, proper transient compensation for updates to injector pulsewidths after they have been scheduled, and proper accounting for dynamic (open-valve) injections. Thus, the present invention improves emissions and drivability by improving transient air/fuel control during engine fueling transients.

While the best modes for carrying out the invention have been described in detail, those familiar with the art to which this invention relates will recognize various alternative designs and embodiments for practicing the invention as defined by the following claims.

What is claimed is:

1. A method for determining fuel mass to be delivered to an individual cylinder of an internal combustion engine during transient engine conditions, the individual cylinder having an intake port for regulating entry of the fuel into the cylinder and having a prior injection history indicating a mass of fuel previously delivered to the individual cylinder, the method comprising:

sensing a plurality of engine parameters;

determining an initial base desired fuel mass based on the plurality of engine parameters;

determining an initial transient fuel mass based on the prior injection history;

determining a desired injected fuel mass to be delivered to the individual cylinder based on the initial base desired fuel mass and the initial transient fuel mass; and sensing delivery of the desired injected fuel mass to the individual cylinder and determining an updated prior injection history based on the desired injected fuel mass and the prior injection history.

2. The method as recited in claim 1 wherein determining the desired injected fuel mass includes controlling the fuel delivered to the individual cylinder based on the desired injected fuel mass.

3. The method as recited in claim 1 further comprising:

sensing a first predetermined event; and determining a new initial transient fuel mass based on the updated prior injection history in response to the first predetermined event.

4. The method as recited in claim 1 wherein determining the initial transient fuel mass includes determining a plurality of model parameters describing fuel transport dynamics of the engine.

5. The method as recited in claim 4 wherein determining the plurality of model parameters includes determining a stability limit.

6. The method as recited in claim 1 wherein determining the desired injected fuel mass to be delivered to the individual cylinder includes:

determining a new base desired fuel mass based on the plurality of engine parameters;

if the new base desired fuel mass exceeds the initial base desired fuel mass by a first predetermined threshold, determining the desired injected fuel mass based on the new base desired fuel mass.

7. The method as recited in claim 6 wherein determining the desired injected fuel mass includes determining a new transient fuel mass based on the prior injection history.

8. The method as recited in claim 7 wherein determining the desired injected fuel mass further includes:

sensing a second predetermined event indicating one of the initial base desired fuel mass and the new base desired fuel mass has been delivered to the cylinder;

determining a second new base desired fuel mass based on the plurality of engine parameters; and determining a dynamic fuel mass based on the second new base desired fuel mass if the second new base desired fuel mass exceeds the initial base desired fuel mass by a second predetermined threshold.

9. The method as recited in claim 8 wherein determining the dynamic fuel mass further includes determining a second new transient fuel mass based on the prior injection history.

10. A system for determining fuel mass to be delivered to an individual cylinder of an internal combustion engine during transient engine conditions, the individual cylinder having an intake port for regulating entry of the fuel into the cylinder and having a prior injection history indicating a mass of fuel previously delivered to the individual cylinder, the method comprising:

a plurality of sensors for sensing a plurality of engine parameters; and control logic operative to determine an initial base desired fuel mass based on the plurality of engine parameters, determine an initial transient fuel mass based on the prior injection history, determine a desired injected fuel mass to be delivered to the individual cylinder based on the initial base desired fuel mass and the initial transient fuel mass, and sense delivery of the desired injected fuel mass to the individual cylinder and determine an updated prior injection history based on the desired injected fuel mass and the prior injection history.

11. The system as recited in claim 10 wherein the control logic is further operative to control the fuel delivered to the individual cylinder based on the desired injected fuel mass.

12. The system as recited in claim 10 wherein the control logic is further operative to sense a first predetermined event corresponding to actual delivery of the desired injected fuel mass and determine a new initial transient fuel mass based on the updated prior injection history.

13. The system as recited in claim 10 wherein the control logic, in determining the initial transient fuel mass, is further operative to determine a plurality of model parameters describing fuel transport dynamics of the engine.

14. The system as recited in claim 13 wherein the control logic, in determining the plurality of model parameters, is further operative to determine a stability limit.

15. The system as recited in claim 10 wherein the control logic, in determining the desired injected fuel mass to be delivered to the individual cylinder, is further operative to determine a new base desired fuel mass to be delivered to the individual cylinder based on the plurality of engine parameters, and if the new base desired fuel mass exceeds the initial base desired fuel mass by a first predetermined threshold, determine the desired injected fuel mass based on the new base desired fuel mass.

16. The system as recited in claim 15 wherein the control logic, in determining the desired injected fuel mass, is further operative to determine a new transient fuel mass based on the prior injection history.

17. The system as recited in claim 16 wherein the control logic, in determining the desired injected fuel mass, is further operative to sense a second predetermined event indicating one of the initial base desired fuel mass and the new base desired fuel mass has been delivered to the cylinder, determine a second new base desired fuel mass based on the plurality of engine parameters, and determine a dynamic fuel mass based on the second new base desired fuel mass if the second new base desired fuel mass exceeds the initial base desired fuel mass by a second predetermined threshold.

18. The system as recited in claim 17 wherein the control logic, in determining the dynamic fuel mass, is further operative to determine a second new transient fuel mass based on the prior injection history.

* * * * *